US010730721B2

(12) United States Patent
Kato et al.

(10) Patent No.: US 10,730,721 B2
(45) Date of Patent: Aug. 4, 2020

(54) ROPE CLEANING DEVICE

(71) Applicant: Otis Elevator Company, Farmington, CT (US)

(72) Inventors: Mitsuru Kato, Chiba (JP); Hirotomo Tanaka, Chiba (JP)

(73) Assignee: OTIS ELEVATOR COMPANY, Farmington, CT (US)

( * ) Notice: Subject to any disclaimer, the term of this patent is extended or adjusted under 35 U.S.C. 154(b) by 161 days.

(21) Appl. No.: 15/910,109

(22) Filed: Mar. 2, 2018

(65) Prior Publication Data

US 2019/0270614 A1 Sep. 5, 2019

(51) Int. Cl.

| | |
|---|---|
| ***B66B 7/12*** | (2006.01) |
| ***B08B 1/00*** | (2006.01) |
| ***B08B 1/02*** | (2006.01) |
| ***B08B 1/04*** | (2006.01) |

(52) U.S. Cl.

CPC ..... *B66B 7/1284* (2013.01); *B08B 1/005* (2013.01); *B08B 1/02* (2013.01); *B08B 1/04* (2013.01)

(58) Field of Classification Search

CPC ..... B66B 7/1284; B08B 1/00; B08B 1/001; B08B 1/005; B08B 1/006; B08B 1/02; B08B 1/04; B08B 11/00

USPC .... 15/104.04, 220.4, 256.5, 256.6; 187/414; 184/15.1; 198/494, 497–499; 474/92

See application file for complete search history.

(56) References Cited

U.S. PATENT DOCUMENTS

| | | | | |
|---|---|---|---|---|
| 2,821,730 A * | 2/1958 | Shellman | ..... | E21B 33/08 15/220.4 |
| 4,570,285 A | 2/1986 | Skelton | | |
| 4,982,473 A | 1/1991 | Farris et al. | | |
| 9,649,667 B2 * | 5/2017 | Wright | ..... | B05C 1/04 |

FOREIGN PATENT DOCUMENTS

| | | | |
|---|---|---|---|
| CN | 2428229 | Y | 5/2001 |
| CN | 102814307 | A | 12/2012 |
| CN | 102971093 | A | 3/2013 |
| CN | 103357599 | A | 10/2013 |
| CN | 203486705 | U | 3/2014 |
| CN | 104307775 | A | 1/2015 |
| CN | 105149256 | A | 12/2015 |
| CN | 103449280 | B | 6/2016 |
| CN | 105921443 | A | 9/2016 |
| CN | 106006297 | A | 10/2016 |
| CN | 205667960 | U | 11/2016 |
| DE | 4446448 | * | 6/1996 |

(Continued)

OTHER PUBLICATIONS

Partial machine translation JP 2016-088719, May 2016.*
European Search Report for application EP 19160291.1, dated Jul. 23, 2019, 76 pages.

*Primary Examiner* — Mark Spisich
(74) *Attorney, Agent, or Firm* — Cantor Colburn LLP

(57) ABSTRACT

According to one embodiment, a rope cleaning device comprises a scraper ring which engages grooves between strands of a wire rope to scrape out foreign material from the grooves as the wire rope passes through the scraper ring, a wiper ring positioned in series with the scraper ring for wiping the surface of the wire rope as the wire rope passes through the wiper ring and a rotational mechanism which allows the scraper ring to rotate about the axis of the wire rope.

17 Claims, 7 Drawing Sheets

(56) References Cited

FOREIGN PATENT DOCUMENTS

| | | | | |
|---|---|---|---|---|
| GB | 858832 | A | | 1/1961 |
| GB | 1237185 | | * | 6/1971 |
| JP | S57181387 | U | | 11/1982 |
| JP | 6-198235 | | * | 7/1994 |
| JP | H07108229 | A | | 4/1995 |
| JP | 9-12247 | | * | 1/1997 |
| JP | 2003190888 | A | | 7/2003 |
| JP | 2011194386 | A | | 10/2011 |
| JP | 20150167915 | A | | 9/2015 |
| JP | 2016088719 | A | | 5/2016 |
| WO | 2012/039046 | | * | 3/2012 |

* cited by examiner

ROPE CLEANING DEVICE

BACKGROUND

This invention generally relates to a device for cleaning wire ropes or cables, such as those used in elevator systems.

Wire ropes or cables conventionally used in elevator systems are typically fabricated from multiple strands spirally wrapped around a core, and each strand contains multiple individual wires. The ropes require lubrication by grease in order to operate properly. In the course of operation, the wire ropes become covered with contaminants that adhere to the grease and to the wire ropes themselves. The contaminants consist essentially of dirt, dust and rust produced by external sources of moisture. For safety reasons, the wire ropes must be periodically cleaned, inspected and lubricated to prevent deterioration and possible operating danger.

Inspection of the wire ropes typically involves visually checking wire breakage or wear marks on the surface of the ropes and measuring rope diameter. Accordingly, the wire ropes need to be cleaned before inspection to an extent that the surface of the wire rope may be clearly viewed. Wire ropes have usually been cleaned by hand, using rags and wire brushes. Such manual cleaning is both labor intensive and time consuming and may be dangerous since the wire rope is usually moved during cleaning.

Various types of non-manual cleaning devices are known in the art such as cloth type cleaning devices, brush type cleaning devices, scraper type cleaning devices or rotation type cleaning devices. However, there is no non-manual cleaning device which effectively cleans both the grooves between rope strands and the surface of the ropes such that the wire rope is ready for inspection without requiring further cleaning by hand.

BRIEF SUMMARY

According to one embodiment, a rope cleaning device comprises a scraper ring which engages grooves between strands of a wire rope to scrape out foreign material from the grooves as the wire rope passes through the scraper ring, a wiper ring positioned in series with the scraper ring for wiping the surface of the wire rope as the wire rope passes through the wiper ring and a rotational mechanism which allows the scraper ring to rotate about the axis of the wire rope.

In addition to one or more of the features described above, or as an alternative, further embodiments may be included wherein the scraper ring is positioned upstream of the wiper ring with respect to the direction of movement of the wire rope.

In addition to one or more of the features described above, or as an alternative, further embodiments may be included wherein the scraper ring comprises a deformable resin or hard rubber material and includes a central opening having helical projections and depressions on the inner circumferential surface thereof shaped complementary to the surface of the wire rope, the projections of the scraper ring engaging the grooves of the wire rope.

In addition to one or more of the features described above, or as an alternative, further embodiments may be included wherein said deformable resin or hard rubber material is polyurethane.

In addition to one or more of the features described above, or as an alternative, further embodiments may be included wherein the wiper ring comprises a deformable resin or hard rubber material and includes a central opening having a diameter D1 smaller than the diameter of the wire rope.

In addition to one or more of the features described above, or as an alternative, further embodiments may be included wherein the diameter D1 is about 91 to 96 percent of the wire rope diameter.

In addition to one or more of the features described above, or as an alternative, further embodiments may be included wherein the wiper ring is stationary with respect to the frame.

In addition to one or more of the features described above, or as an alternative, further embodiments may be included wherein said deformable resin or hard rubber material is polyurethane.

In addition to one or more of the features described above, or as an alternative, further embodiments may be included comprising a frame for supporting the scraper ring and the wiper ring, the frame including an upper plate and a lower plate connected.

In addition to one or more of the features described above, or as an alternative, further embodiments may be included wherein the upper plate and the lower plate are connected by bolts which serve as a guide for the scraper ring.

In addition to one or more of the features described above, or as an alternative, further embodiments may be included wherein the rotational mechanism includes a low friction tape on the upper surface of a plate and a slider ring comprising a thin sheet of low friction material positioned in contact with the low friction tape.

In addition to one or more of the features described above, or as an alternative, further embodiments may be included wherein the low friction tape comprises a polytetrafluoroethylene (PTFE) tape or an ultra high molecular weight polyethylene tape and the slider ring comprises polypropylene.

In addition to one or more of the features described above, or as an alternative, further embodiments may be included wherein the rotational mechanism includes ball rollers.

In addition to one or more of the features described above, or as an alternative, further embodiments may be included comprising a cover fit onto the scraper ring, which prevents the foreign material from flying into the surrounding environment.

In addition to one or more of the features described above, or as an alternative, further embodiments may be included wherein the wiper ring is cylindrical and includes a semicylindrical first bracket and a semicylindrical second bracket positioned around the wire rope and bolted together, with a cloth positioned between the wire rope and the brackets so that the cloth rubs against the wire rope when the wire rope passes through the wiper ring.

In addition to one or more of the features described above, or as an alternative, further embodiments may be included wherein the wiper ring rotates together with the scraper ring.

In addition to one or more of the features described above, or as an alternative, further embodiments may be included wherein the cloth extends outwardly from between the lateral ends of the brackets and is secured in place by the brackets.

In addition to one or more of the features described above, or as an alternative, further embodiments may be included wherein the cleaning device is attached to the wire rope during maintenance.

The foregoing features and elements may be combined in various combinations without exclusivity, unless expressly indicated otherwise. These features and elements as well as the operation thereof will become more apparent in light of the following description and the accompanying drawings. It should be understood, however, that the following description and drawings are intended to be illustrative and explanatory in nature and non-limiting.

BRIEF DESCRIPTION OF THE DRAWINGS

The foregoing and other features, and advantages of the disclosure are apparent from the following detailed description taken in conjunction with the accompanying drawings in which like elements are numbered alike in the several FIGS.

DETAILED DESCRIPTION

Figure 1:
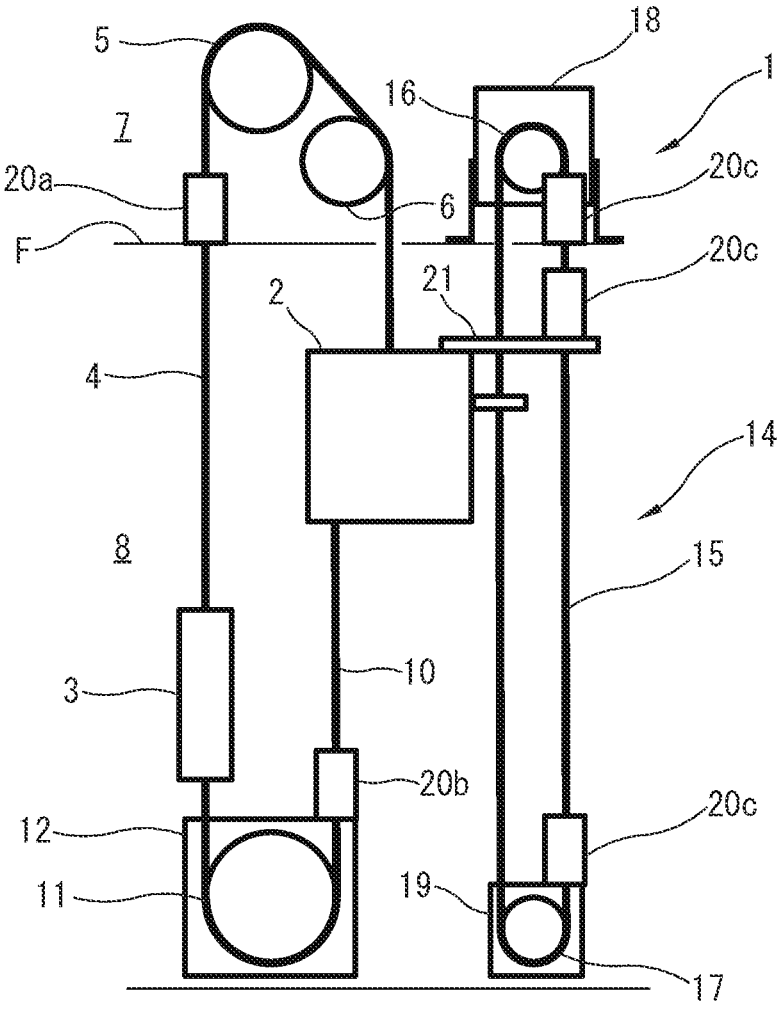
FIG. 1 illustrates a schematic view of an exemplary elevator system in which the rope cleaning device of the present invention may be used.

FIG. 1 schematically illustrates selected portions of an example elevator system 1. An elevator car 2 is connected to a counterweight 3 by a plurality of hoisting ropes 4. The ropes 4 extend over a traction sheave 5 and a deflector sheave 6. The traction sheave 5 is driven by a machine (not shown) which may be positioned in a machine room 7. Traction between the traction sheave 5 and the ropes 4 drives the car 2 and the counterweight 3 vertically through a hoistway 8.

At least one compensation rope 10 is provided to compensate for the weight of the hoisting ropes 4 and reduce the load of the machine. One end of the compensation rope 10 is connected to the bottom of the elevator car 2 and the other end of the compensation rope 10 is connected to the bottom of the counterweight 3. To maintain the tension of the compensation rope 10, a compensation sheave 11 is suspended at the bottom of the hoistway 8 and pulls the compensation rope 10 downward under the effect of gravity, for example. In this example, the compensation sheave 11 is positioned in a frame 12.

A governor device 14 prevents the elevator car 2 from exceeding a maximum speed. The governor device 14 includes a governor rope 15 that travels with the elevator car 2. A governor sheave 16 and a tension sheave 17 are located at opposite ends of a loop formed by the governor rope 15. In this example, the governor sheave 16 and the tension sheave 17 are each positioned within a frame 18, 19. The configuration of the elevator system components may vary from this example in various aspects. In other words, the invention is not necessarily limited to the example elevator system configuration or the specific components of the illustration.

The hoisting ropes 4, the at least one compensation rope 10 and the governor rope 15 are wire ropes typically fabricated from multiple of strands that are spirally wrapped around a core, and each strand contains multiple individual wires. During maintenance, the rope cleaning device 20 of the present invention may be attached to the wire ropes in order to remove foreign material adhering to the ropes. Such foreign material may include sludge, grease and contaminants such as dirt, dust and rust or any other foreign objects which may adhere to the ropes.

Exemplary positions in which the rope cleaning device 20 may be attached to the wire ropes during maintenance are shown in FIG. 1. The rope cleaning device 20*a* for the hoisting ropes 4 may be positioned on the floor F of the machine room 7. The rope cleaning device 20*b* for the compensation rope 10 may be positioned on the frame 12 of the compensation sheave 11 and the rope cleaning device 20*c* for the governor rope 15 may be positioned on the floor F of the machine room 7, on the frame 19 of the tension sheave 17 or on a plate 21 extending from the elevator car 2. However, the rope cleaning device 20 may be attached to the wire ropes at any position where the rope cleaning device 20 may be stationarily supported and may allow the wire ropes to move there through. During maintenance, the wire ropes are moved through the rope cleaning device 20 in one direction at a maintenance speed which is slower than a normal operation speed.

Figure 2:
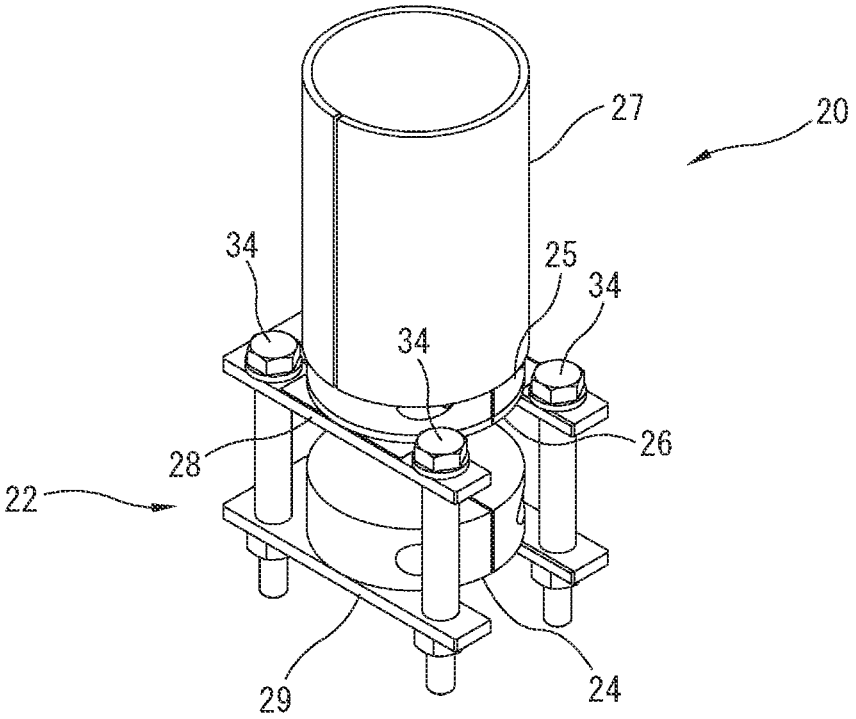
FIG. 2 illustrates a perspective view of a first embodiment of the rope cleaning device of the present invention.

FIG. 2 shows a perspective view of a first embodiment of the rope cleaning device 20. The rope cleaning device 20 comprises a frame 22, a wiper ring 24, a scraper ring 25, a slider ring 26, and a cover 27. The details of the parts are shown in FIGS. 3 to 8.

Figure 3:
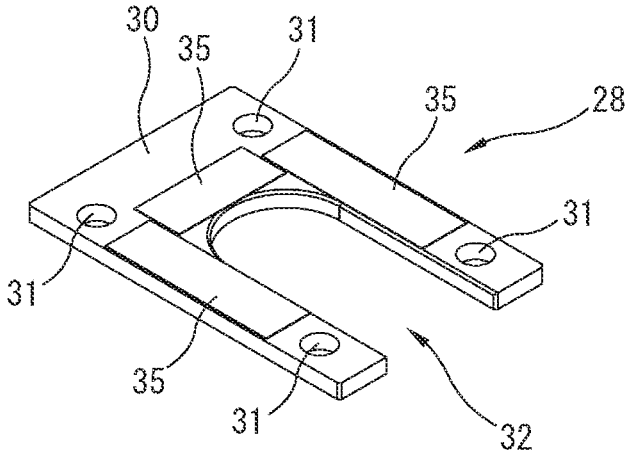
FIG. 3 illustrates an upper plate of a frame of the rope cleaning device of FIG. 2.
Figure 4:
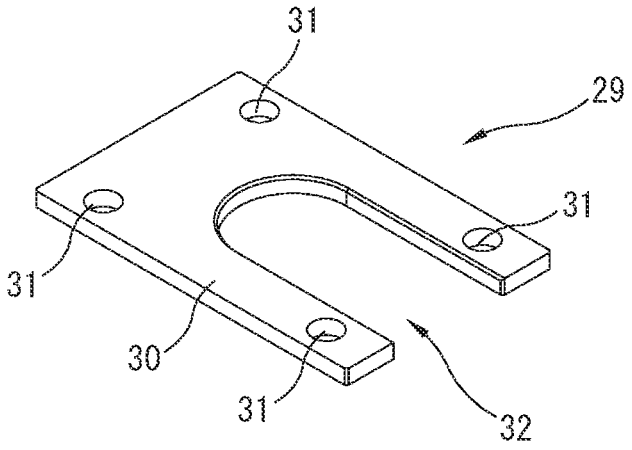
FIG. 4 illustrates a lower plate of a frame of the rope cleaning device of FIG. 2.

The frame 22 includes an upper plate 28 and a lower plate 29. Referring to FIGS. 3 and 4, the plates 28, 29 may both comprise rectangular steel plates 30 with bolt holes 31 at four corners thereof. The plates both have a U-shaped notch 32 on an end which faces the wire rope when the rope cleaning device 20 is attached to the rope. The plates 28, 29 are assembled via bolts 34 to form a support structure (frame 22) for supporting the wiper ring 24 and the scraper ring 25. A low friction tape 35 is adhered to the upper surface of the upper plate 28. The low friction tape 35 may comprise a polytetrafluoroethylene (PTFE) tape or an ultra high molecular weight polyethylene tape, for example. It is also possible to provide a resin coating such as a PTFE or perfluoroalkoxy alkane (PFA) coating on the upper surface of the upper plate 28 in place of the low friction tape 35 to provide a low friction surface.

Figure 5:
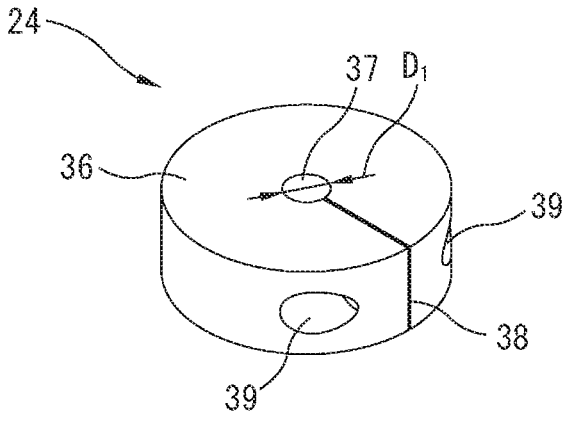
FIG. 5 illustrates a wiper ring of the rope cleaning device of FIG. 2.

With reference to FIG. 5, the wiper ring 24 has a cylindrical body 36 with a central opening 37 having a diameter D1 smaller than the diameter of the wire rope. The cylindrical body 36 comprises a deformable resin or hard rubber material such as polyurethane, for example. A slit 38 extends from the outer diameter to the inner diameter of the wiper ring 24 and a pair of bolt holes 39 is provided for bolting the ends of the wiper ring 24 separated by the slit 38 after placing the wiper ring 24 around the wire rope. The central opening 37 may have a simple circular shape and the diameter D1 may be about 91 to 96 percent of the wire rope diameter.

Figure 6:
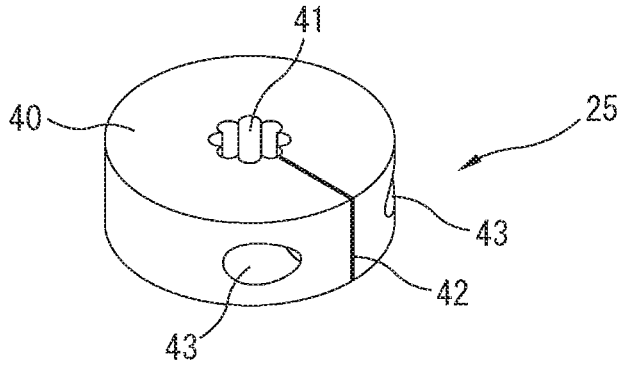
FIG. 6 illustrates a scraper ring of the rope cleaning device of FIG. 2.

Referring to FIG. 6, the scraper ring 25 has a cylindrical body 40 with a central opening 41 having helical projections and depressions on the inner circumferential surface thereof similar to the wire rope. The helical projections and depressions of the scraper ring 25 are shaped complementary to the helical projections and depressions on the outer surface of the wire rope. The cylindrical body 40 comprises a deformable resin or hard rubber material such as polyurethane, for example. The scraper ring 25 further comprises a slit 42 extending from the outer diameter to the inner diameter thereof and a pair of bolt holes 43 for bolting the ends of the scraper ring 25 separated by the slit 42 after placing the scraper ring 25 around the wire rope.

Figure 7:
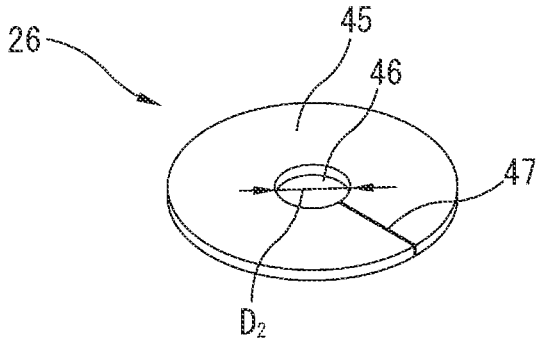
FIG. 7 illustrates a slider ring of the rope cleaning device of FIG. 2.

With reference to FIG. 7, the slider ring 26 comprises a circular sheet 45 of a low friction material such as polypropylene. The slider ring 26 includes a central opening 46 having a diameter D2 slightly larger than the wire rope diameter to allow the wire rope to pass through without interfering with the slider ring 26 and a slit 47 extending from the outer diameter to the inner diameter thereof.

Figure 8:
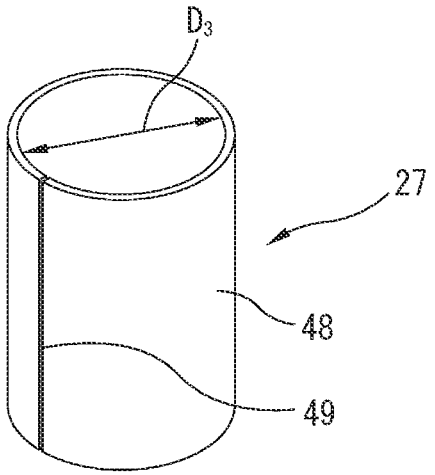
FIG. 8 illustrates a cover of the rope cleaning device of FIG. 2.

With reference to FIG. 8, the cover 27 has a hollow cylindrical body 48 made of unplasticized polyvinyl chloride, for example. The cover 27 includes a lengthwise extending slit 49 and an inner diameter D3 slightly smaller than the outer diameter of the scraper ring 25 such that the cover 27 may be fit onto the scraper ring 25 without using any fixing elements.

Figure 9:
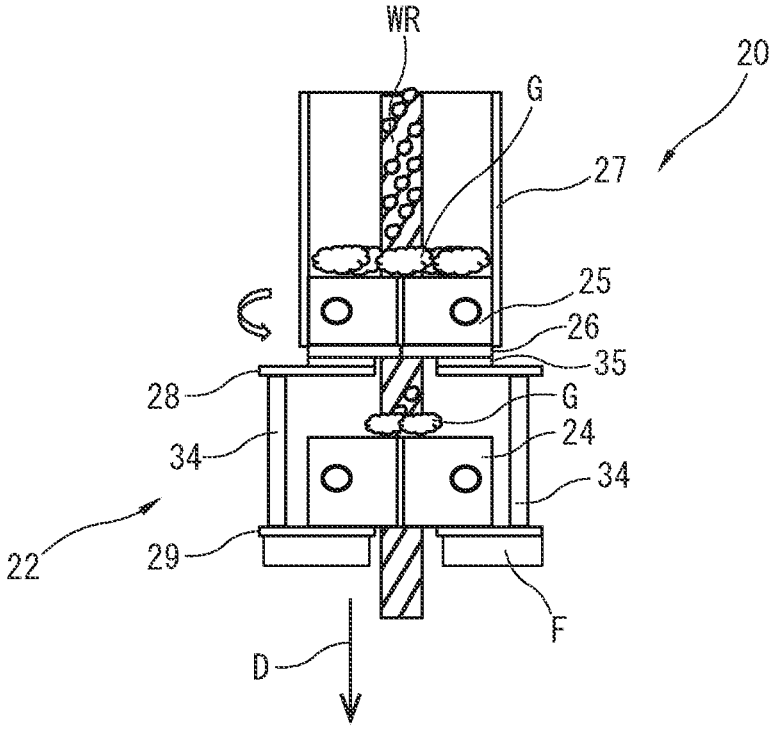
FIG. 9 illustrates a longitudinal sectional view of the rope cleaning device of FIG. 2 attached to a wire rope.

FIG. 9 shows a longitudinal sectional view of the rope cleaning device 20 attached to a wire rope WR. The frame 22 is placed on the floor F of the machine room 7, for example, and around the wire rope WR. The frame 22 may be fixed to the floor F to prevent rotation of the frame 22 during cleaning. The wiper ring 24 and the scraper ring 25 are supported on the frame 22. The wiper ring 24 is fit on the wire rope WR and placed on the lower plate 29 of the frame 22. The wiper ring 24 may be fit on the wire rope WR by pulling apart the ends of the wiper ring 24 separated by the slit 38 and placing the wiper ring 24 around the wire rope WR. The ends of the wiper ring 24 may be bolted together. The slider ring 26 is fit on the wire rope WR and placed on the upper plate 28 such that it contacts the low friction tape 35 adhered to the upper plate 28. The slider ring 26 may be fit on the wire rope WR in a similar manner as the wiper ring 24.

The scraper ring 25 is also fit on the wire rope WR in a similar manner as the wiper ring 24 so that the projections and depressions on the inner circumferential surface thereof match the complementary projections and depressions on the rope surface and is placed on top of the slider ring 26. The ends of the scraper ring may be bolted together. The scraper ring 25 is allowed to rotate via low frictional contact between the slider ring 26 and the low friction tape 35. The cover 27 is pressed onto the scraper ring 25.

After the rope cleaning device 20 is attached to the wire rope WR, the rope is moved in direction D, i.e., downward, at a maintenance speed. The projections on the inner circumferential surface of the scraper ring 25 engage the helical grooves between the strands of the wire rope WR and scrape out sludge or grease G within the grooves. This causes the scraper ring 25 to rotate about the wire rope axis. The cover 27 rotates together with the scraper ring 25 and prevents the sludge or grease G from flying into the surrounding environment. As the wire rope WR further proceeds in direction D, the stationary wiper ring 24 wipes off the remaining sludge or grease G on the surface of the rope WR.

The bolts 34 of the frame 22 of the rope cleaning device 20 not only connect the upper plate 28 and lower plate 29 but also function as a guide for the scraper ring 25. This arrangement also prevents swaying of the wire rope WR while the rope moves through the rope cleaning device 20.

The rope cleaning device 20*a*, 20*b*, 20*c* for the hoisting ropes 4, the at least one compensation rope 10 and the governor rope 15 may be identical except for the inner diameter dimensions of the wiper ring 24, scraper ring 25 and slider ring 26. The rope cleaning device 20*a* for the plurality of hoisting ropes 4 may be installed on every other hoisting rope 4. However, it is also possible to install the rope cleaning device 20*a* on all of the hoisting ropes 4.

Figure 10:
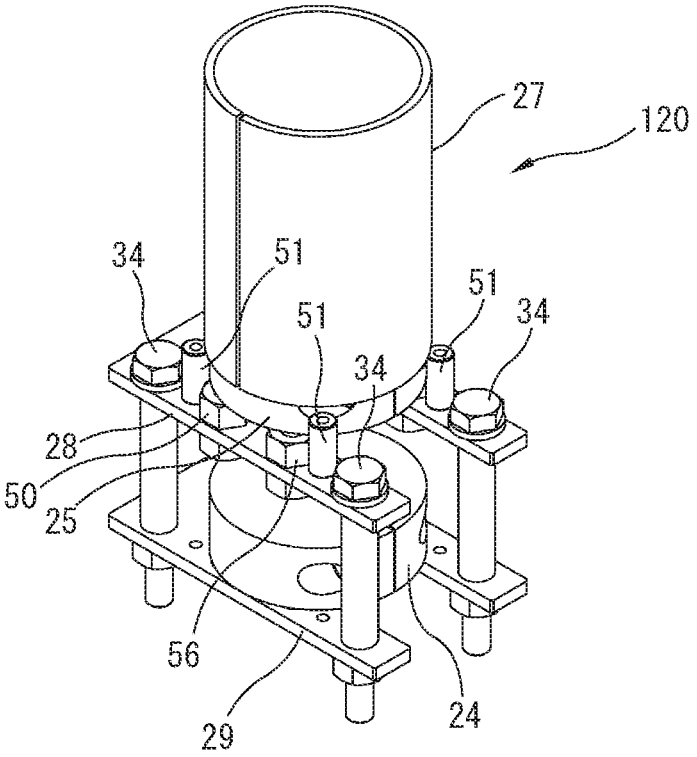
FIG. 10 illustrates a perspective view of a second embodiment of the rope cleaning device of the present invention.

FIG. 10 shows a second embodiment of the rope cleaning device 120 wherein low frictional contact allowing rotation of the scraper ring 25 is provided by ball rollers 50 instead of the slider ring 26 and low friction tape 35 arrangement. Further, guiding members 51 are provided for guiding the scraper ring 25. The ball rollers 50 are advantageous in that they have a high wear resistance. On the other hand, the slider ring 26 and low friction tape 35 provides an arrangement which may lower the cost of the rope cleaning device.

Figure 11:
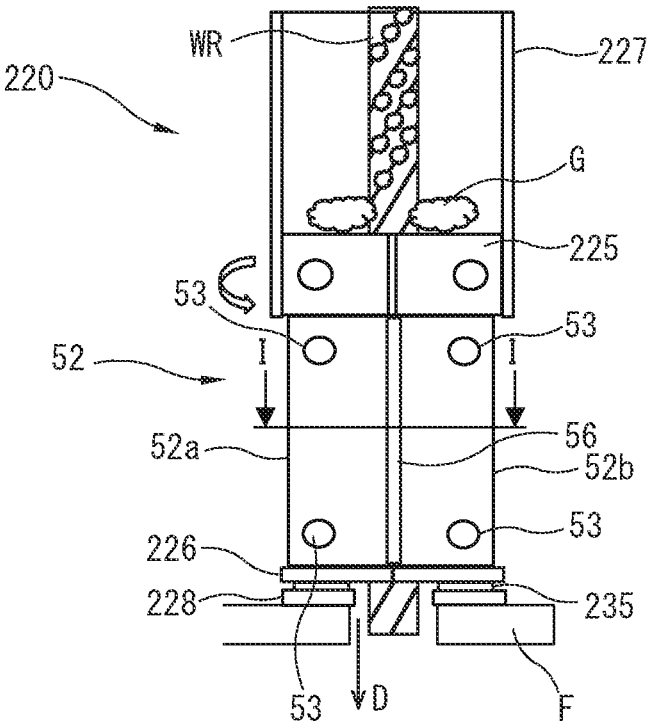
FIG. 11 illustrates a longitudinal sectional view of a third embodiment of the rope cleaning device of the present invention attached to a wire rope.
Figure 12:
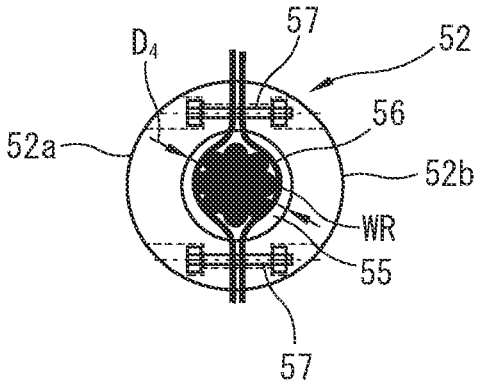
FIG. 12 illustrates a cross sectional view taken along I-I of FIG. 11.

FIGS. 11 and 12 show a third embodiment of the rope cleaning device 220. FIG. 11 is a longitudinal sectional view of the rope cleaning device 220 and FIG. 12 is a cross sectional view of the rope cleaning device 220 taken along I-I of FIG. 11. The rope cleaning device 220 comprises a base plate 228, a slider ring 226, a wiper 52, a scraper ring 225, and a cover 227. The base plate 228 may be identical to the upper plate 28 of the first embodiment. A low friction tape 235 similar to the low friction tape 35 is adhered to the upper surface of the base plate 228. The slider ring 226, the scraper ring 225 and the cover 227 may also be identical to the slider ring 26, the scraper ring 25 and the cover 27 of the first embodiment.

The wiper 52 is cylindrical and comprises a semicylindrical first bracket 52*a* and a semicylindrical second bracket 52*b* each having two pairs of bolt holes 53 at lateral ends thereof. The wiper 52 has a central opening 55 formed by a semicircular recess on each bracket 52*a*, 52*b*. The central opening 55 may have a simple circular shape and a diameter D4 at least as large as the wire rope diameter. The wiper 52 further includes at least one cloth 56. The cloth 56 may be a non-woven material, felt or waste cloth, for example.

The base plate 228 is placed around the wire rope WR and may be bolted to the floor F of the machine room 7, for example. The slider ring 226 is fit on the wire rope WR and placed on the base plate 228 such that it contacts the low friction tape 235 adhered to the base plate 228. The first and second brackets 52*a*, 52*b* are arranged around the wire rope WR and bolted together by bolts 57, with the cloth 56 placed around the wire rope WR and fit between the wire rope WR and the recess of the brackets 52*a*, 52*b*. The cloth 56 may be positioned so that the lateral ends thereof extend outwardly from between the lateral ends of the brackets 52*a*, 52*b* and are secured in position by the brackets 52*a*, 52*b*. The diameter D4 of the central opening 55 of the wiper 52 and the thickness of the cloth 56 is selected so that the cloth 56 rubs against the wire rope WR when the rope moves through the wiper 52.

The wiper 52 is placed on the slider ring 235 and is allowed to rotate via the low frictional contact between the slider ring 226 and the low friction tape 235. The scraper ring 225 is fit on the rope so that the projections and depressions on the inner circumferential surface thereof match the complementary projections and depressions on the wire rope surface and is placed on top of the wiper 52. The cover 227 is pressed onto the scraper ring 225.

After the rope cleaning device 220 is attached to the wire rope WR, the rope is moved in direction D at a maintenance speed. The projections on the inner circumferential surface of the scraper ring 225 engage the helical grooves between the strands of the wire rope WR and scrape out sludge or grease G within the grooves. This causes the scraper ring 225 to rotate about the wire rope axis and also causes the rotation of the wiper 52 via frictional contact between the upper surface of the wiper 52 and the lower surface of the scraper ring 225. The cover 227 rotates together with the scraper ring 225 and prevents the sludge or grease G from flying into the surrounding environment. As the wire rope WR further proceeds in direction D, the remaining sludge or grease on the surface of the wire rope WR is wiped off by the cloth 56 of the wiper 52 rotating about the wire rope axis together with the scraper ring 225.

The rope cleaning device of the present invention provides a compact two-step mechanism in which not only sludge or grease in the helical grooves between strands of the wire rope are scrapped out but also sludge or grease adhering to the surface of the wire rope is wiped off to provide a clean wire rope ready for inspection without requiring the time or risk of manually cleaning the wire rope or for manually cleaning the wire rope after using a cloth type, brush type, scraper type or rotation type rope cleaning device.

The terminology used herein is for the purpose of describing particular embodiments only and is not intended to be limiting. While the description has been presented for purposes of illustration and description, it is not intended to be exhaustive or limited to embodiments in the form disclosed. Many modifications, variations, alterations, substitutions or equivalent arrangement not hereto described will be apparent to those of ordinary skill in the art without departing from the scope of the disclosure. Additionally, while the various embodiments have been described, it is to be understood that aspects may include only some of the described embodiments. Accordingly, the disclosure is not to be seen as limited by the foregoing description, but is only limited by the scope of the appended claims.

What is claimed is:

1. A rope cleaning device, comprising:

a scraper ring which engages grooves between strands of a wire rope to scrape out foreign material from the grooves as the wire rope passes through the scraper ring;

a wiper ring positioned in series with the scraper ring for wiping the surface of the wire rope as the wire rope passes through the wiper ring;

a rotational mechanism which allows the scraper ring to rotate about the axis of the wire rope;

a frame for supporting the scraper ring and the wiper ring, the frame including an upper plate and a lower plate;

wherein the rotational mechanism includes ball rollers located between the scraper ring and a respective one of the upper and lower plates.

2. The rope cleaning device of claim 1, wherein the scraper ring is positioned upstream of the wiper ring with respect to the direction of movement of the wire rope.

3. The rope cleaning device of claim 1, wherein the scraper ring comprises a deformable resin or hard rubber material and includes a central opening having helical projections and depressions on the inner circumferential surface thereof shaped complementary to the surface of the wire rope, the projections of the scraper ring engaging the grooves of the wire rope.

4. The rope cleaning device of claim 3, wherein said deformable resin or hard rubber material is polyurethane.

5. The rope cleaning device of claim 1, wherein the wiper ring comprises a deformable resin or hard rubber material and includes a central opening having a diameter D1 smaller than the diameter of the wire rope.

6. The rope cleaning device of claim 5, wherein the diameter D1 is about 91 to 96 percent of the wire rope diameter.

7. The rope cleaning device of claim 5, wherein said deformable resin or hard rubber material is polyurethane.

8. The rope cleaning device of claim 1, wherein the wiper ring is stationary with respect to the frame.

9. The rope cleaning device of claim 1, wherein the upper plate and the lower plate are connected by bolts which serve as a guide for the scraper ring.

10. The rope cleaning device of claim 1, further comprising a cover fit onto the scraper ring, which prevents the foreign material from flying into the surrounding environment.

11. The rope cleaning device of claim 1, wherein the rope cleaning device is attached to the wire rope during maintenance.

12. A rope cleaning device, comprising:

a scraper ring which engages grooves between strands of a wire rope to scrape out foreign material from the grooves as the wire rope passes through the scraper ring;

a wiper ring positioned in series with the scraper ring for wiping the surface of the wire rope as the wire rope passes through the wiper ring; and a rotational mechanism which allows the scraper ring to rotate about the axis of the wire rope;

wherein the rotational mechanism includes a low friction tape on the upper surface of a plate.

13. The rope cleaning device of claim 12, the rotational mechanism includes a slider ring comprising a thin sheet of low friction material positioned in contact with the low friction tape.

14. The rope cleaning device of claim 13, wherein the low friction tape comprises a polytetrafluoroethylene (PTFE) tape or an ultra high molecular weight polyethylene tape and the slider ring comprises polypropylene.

15. A rope cleaning device, comprising:

a scraper ring which engages grooves between strands of a wire rope to scrape out foreign material from the grooves as the wire rope passes through the scraper ring;

a wiper ring positioned in series with the scraper ring for wiping the surface of the wire rope as the wire rope passes through the wiper ring; and a rotational mechanism which allows the scraper ring to rotate about the axis of the wire rope;

wherein the wiper ring is cylindrical and includes a semicylindrical first bracket and a semicylindrical second bracket positioned around the wire rope and bolted together, with a cloth positioned between the wire rope and the brackets so that the cloth rubs against the wire rope when the wire rope passes through the wiper ring.

16. The rope cleaning device of claim 15, wherein the wiper ring rotates together with the scraper ring.

17. The rope cleaning device of claim 15, wherein the cloth extends outwardly from between the lateral ends of the brackets and is secured in place by the brackets.

* * * * *